US010866074B1

(12) United States Patent
Morton

(10) Patent No.: US 10,866,074 B1
(45) Date of Patent: Dec. 15, 2020

(54) BROADHEAD

(71) Applicant: Nicholas Morton, Brisbane (AU)

(72) Inventor: Nicholas Morton, Brisbane (AU)

( * ) Notice: Subject to any disclaimer, the term of this patent is extended or adjusted under 35 U.S.C. 154(b) by 0 days.

(21) Appl. No.: 16/275,306

(22) Filed: Feb. 13, 2019

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 3,653,664 A * 4/1972 Gentellalli ..... F42B 6/08 473/583
3,815,916 A * 6/1974 Meszaros ..... F42B 6/06 473/586
4,210,330 A * 7/1980 Kosbab ..... F42B 6/08 473/584
7,182,706 B2 * 2/2007 Barrie ..... F42B 6/08 473/584
7,597,637 B2 * 10/2009 Sohm ..... F42B 6/08 473/583
8,771,113 B2 * 7/2014 Patton ..... F42B 6/08 473/583
9,157,710 B1 * 10/2015 Huntsman ..... F42B 6/08
10,054,409 B2 * 8/2018 Vanderheyden ..... F42B 6/08
2006/0058124 A1 * 3/2006 Summers ..... F42B 6/08 473/583
2017/0219322 A1 * 8/2017 Huntsman ..... F42B 6/08

* cited by examiner

*Primary Examiner* — John A Ricci
(74) *Attorney, Agent, or Firm* — FRESH IP PLC; Clifford D. Hyra; Aubrey Y. Chen

(57) ABSTRACT

A broadhead for an arrow comprises a plurality of blade portions that extend about a body portion. The blade portions are offset relative to each other and each blade portion extends outwardly from the body portion. The blade portion is shaped with a relatively narrow front tip and expands to a relatively broader rear section. Each blade portion has a beveled outer cutting edge that angles downwardly from a first side to a second side. The arrangement and orientation of the blade portions assists with the rotation of the arrow during flight thereby providing increased accuracy and reduced drag.

10 Claims, 4 Drawing Sheets

BROADHEAD

FIELD OF INVENTION

The present invention relates to arrows, broadheads and bow hunting. The present invention has particular but not exclusive application for bow hunting but the broadhead invention is not limited to this application.

BACKGROUND OF THE INVENTION

A broadhead (or arrowhead) is a large cutting device or assembly attachable to an arrow shaft and used for hunting. An arrow generally comprises a shaft with fletching and a knock at one end to receive a bow string. The other end of the arrow shaft has a broadhead with one or more cutting blades.

The broadhead can have fixed blades, removable or expandable blades. The broadhead described in U.S. Pat. No. 7,597,637 is an assembly comprising a transverse blade with two outwardly disposed blades. The outer edge of each blade has two different angles with the edge section near the tip having an angle that is more acute than the angle of the remainder edge section. The multiple angled edge sections were designed to increase the point strength and enhance the penetrating and cutting ability. The broadhead described in U.S. Ser. No. 10/054,409 is a similar broadhead assembly where an additional shorter transverse blade is fixed closer to the ferrule and designed to strengthen the broadhead. The additional blade is fixed at 90 degrees relative to the larger blade.

The current broadheads with two or more outwardly positioned blades have decreased accuracy because of interference with air flow and providing additional drag. Furthermore, the blades have broken during use and the arrows have been difficult to withdraw from the entry wound particularly if the blade encounters bone.

OBJECT OF THE INVENTION

It is an object of the present invention to provide an alternative broadhead that alleviates at least in part one or more of the above mentioned problems.

SUMMARY OF THE INVENTION

The inventor of the current invention observed that arrows rotate during flight and subsequently developed a broadhead that considered arrow rotation in designing a broadhead with improved arrow flight accuracy and efficient flesh penetration.

In one aspect the present invention is a broadhead having a plurality of blade portions that extend about a body portion; the blade portions are offset relative to each other; each blade portion extends outwardly from the body portion and is shaped with a relatively narrow front tip and expanding to a relatively broader rear section, each blade portion has a beveled outer cutting edge that angles downwardly from a first side to a second side, wherein the blade portions are arranged relative to each other so that the second side of one of the blade portions is proximal to the first side of the adjacent blade portion.

Preferably the offset arrangement of the blade portions and the beveled edges cooperate to assist the rotation of the arrow shaft.

In another aspect the present invention is a broadhead having a plurality of blade portions that extend about a body portion; the blade portions are offset relative to each other; each blade portion extends outwardly from the body portion and is shaped with a relatively narrow front tip and expanding to a relatively broader rear section, each blade portion has a beveled outer cutting edge that angles downwardly from a first side to a second side, wherein in use the offset arrangement of the blade portions and the beveled edges cooperate to facilitate the rotation of the arrow shaft.

The beveled edge of each blade portion is in the same orientation relative to the outward extension of the respective blade portion and the front position of the broadhead.

Preferably the blade portions are spaced equidistant apart from each other. More preferably there are three blade portions spaced equidistant about the body portion.

Each of the blade portions preferably taper in a similar manner from the rear section to the front tip.

Preferably the blade portions and body portion are integral. In an alternate embodiment the blade portions are fixable to the body portion.

Preferably each of the blade portions extends from the body portion so that the second side is substantially continuous and in alignment with a side of the body portion. The surface of the second side of each of the blade portions preferably extends continuously in the same plane to form part of the outer surface of the body portion.

Each of the blade portions is preferably asymmetrical about a perpendicular axis extending through the central longitudinal axis of the broadhead.

The body portion preferably has a plurality of sides. More preferably the body portion has 6 sides forming a hexagon shape in cross-section.

In one embodiment, the blade portion has a triangular pie shape with a beveled outer side.

The arrangement of the blade portions provides a substantially helical type broadhead which rotates during flight and twists with entry into flesh to leave a comparatively clean open wound channel.

The beveled cutting edge of the blade portions preferably has an angled edge section to form a broad tip at the front end.

The body portion preferably includes a threaded section for fixing to the arrow shaft.

In another aspect the present invention is an arrow with a broadhead, said broadhead being one or more of the variations described herein. The arrow preferably includes fletching (comprising feathers and or vanes) attached adjacent an end of the arrow. The fletching is preferably attached at or adjacent one end of the arrow shaft while the broadhead is attached to the opposite end of the arrow shaft. Preferably the blade portions of the broadhead will align with the fletching at the opposite end of the arrow so in coordinated manner promote the rotation of the arrow during flight. The alignment of the blade portions and the fletching preferably reduces drag and increases accuracy of the arrow.

The features described with respect to one aspect also apply where applicable to all other aspects of the invention. Furthermore, different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENT

Figure 1:
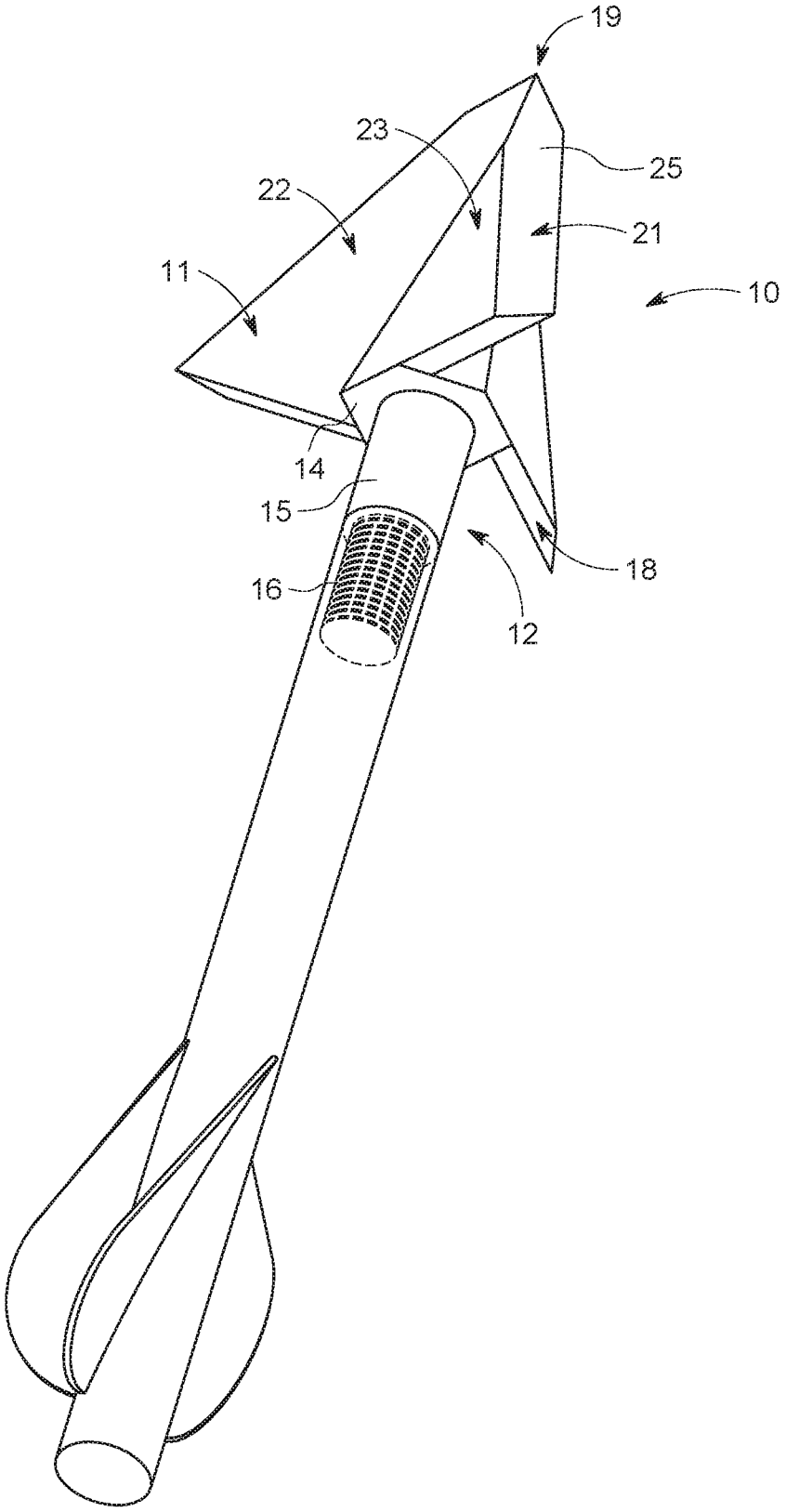
FIG. 1 is a diagrammatic perspective view of a preferred embodiment of the broadhead of the present invention.
Figure 2:
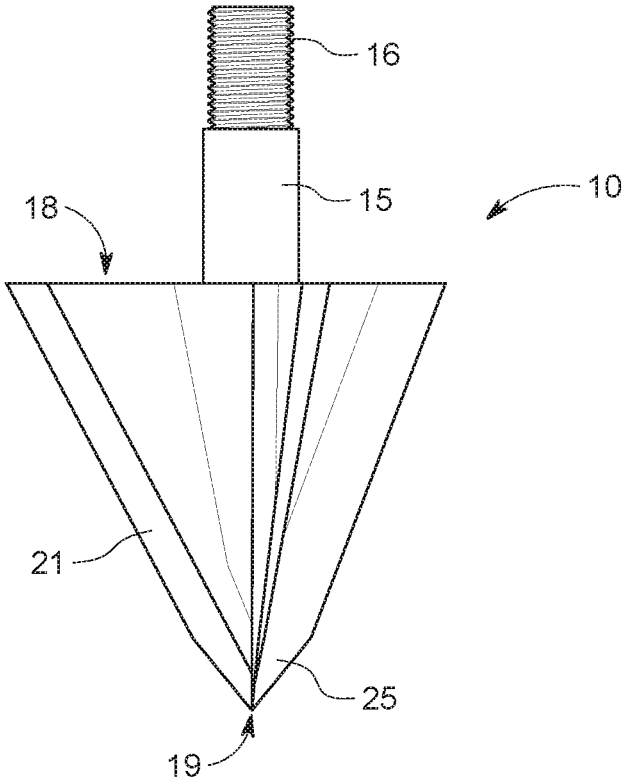
FIG. 2 is a diagrammatic side view of the preferred embodiment of the broadhead of the present invention.
Figure 3:
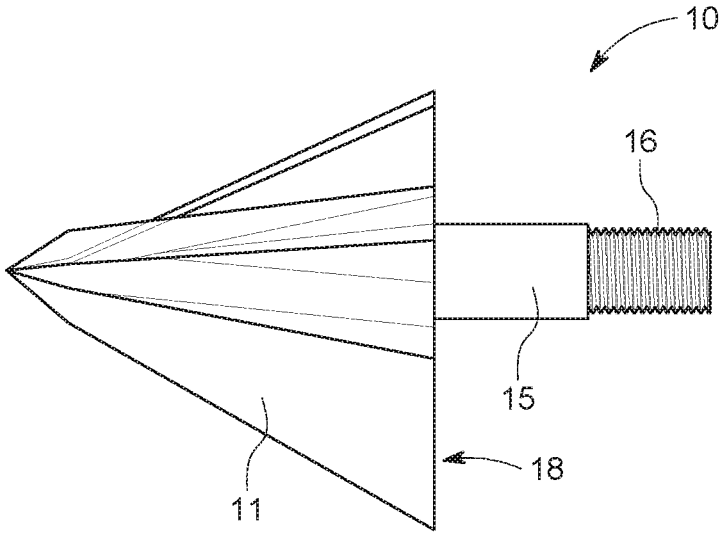
FIG. 3 is a diagrammatic top view of the preferred embodiment of the broadhead of the present invention.
Figure 4:
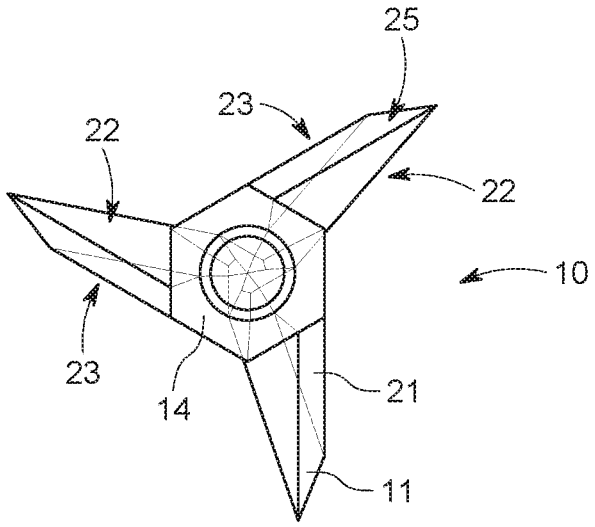
FIG. 4 is a diagrammatic rear view of the preferred embodiment of the broadhead of the present invention.

The preferred embodiment of the broadhead of the present invention is shown in FIGS. 1 to 4. In the Figures, there is shown a broadhead 10 comprising three blade portions 11 and a body portion 12. The blade portions 11 and the body portions 12 are integrally formed to make a single unitary broadhead 10. The body portion 12 has a hexagonal tapered section 14, a cylindrical intermediate section 15 and a threaded end section 16. In use, the threaded end section 16 is inserted into a complementary threaded open sleeve section of an arrow end. The cylindrical intermediate section 15 abuts the arrow end when the broadhead is threaded into the arrow end and fixed in position.

The blade portions 11 are spaced substantially equal distant from each other and about the body portion 12. The blade portions 11 have a substantially triangular shape with a relatively large rear end 18 tapering to a front tip 19. The blade portions 11 extend outwardly but their position is asymmetrical to a perpendicular axis from the central longitudinal axis of the broadhead 10. Each of the blade portions 11 have a beveled outer cutting edge 21. The beveled outer cutting edge 21 extends downwardly from a first side 22 to a second side 23.

The second side of each of the blade portions 11 are proximal to the first side of the adjacent blade portion 11 in the broadhead 10.

The second side 23 of each of the of the blade portions 11 have a surface that is continuous an outer surface of the hexagonal tapered section 14. The blade portions 11 are integrally formed with the body portion 12. The integral unitary nature of the broadhead 10 provides strength to the blade portions 11 and serves to prevent damage to the blade portions 11.

Each of the blade portions 11 have a similar beveled outer cutting edge 21 and are in the same orientation with respect to each other and the front and rear of the broadhead 10.

The beveled outer cutting edge 21 has an angled front section 25 to provide a broad front tip 19. The angled front section 25 provides a relatively stronger front tip 19.

The arrangement of the blade portions 11 about the body portion 12 and the orientation of the beveled outer cutting edge 21 of each blade portion serves to assist in the rotation of the broadhead 10 (and arrow) during the flight of the arrow.

When the broadhead 10 is attached to the arrow, the blade portions 11 are preferably aligned with the fletching at or adjacent the opposite end of the arrow. The alignment of the blade portions 11 and the fletching assist in the rotation of the arrow during flight. The alignment of the blade portions 11 with the fletching increases the accuracy of the arrow and reduces the drag of the arrow through the air.

In use, the broadhead 10 attached to the arrow rotates during flight and twists in the flesh when it hits the animal target. The arrow produces a relatively large open channeled wound compared with conventional arrowheads. The use of this type of broadhead provides a quicker and arguably a more ethical kill of animals than the use of conventional arrowheads.

The broadhead comprises a plurality of blade portions that extend about a body portion. The blade portions are offset relative to each other and each blade portion extends outwardly from the body portion. The blade portion is shaped with a relatively narrow front tip and expands to a relatively broader rear section. Each blade portion has a beveled outer cutting edge that angles downwardly from a first side to a second side. The arrangement and orientation of the blade portions assists with the rotation of the arrow during flight thereby providing increased accuracy and reduced drag.

VARIATIONS

It will of course be realized that while the foregoing has been given by way of illustrative example of this invention, all such and other modifications and variations thereto as would be apparent to persons skilled in the art are deemed to fall within the broad scope and ambit of this invention as is herein set forth. Throughout the description and claims of this specification the word "comprise" and variations of that word such as "comprises" and "comprising", are not intended to exclude other additives, components, integers or steps.

The invention claimed is:

1. A broadhead for an arrow, said broadhead comprising:

three blade portions spaced equidistant about a body portion;

wherein the body portion has a section that has a hexagonal shape;

wherein the blade portions are offset relative to each other;

wherein each blade portion extends outwardly from the body portion and is shaped with a relatively narrow front tip and expands to a relatively broader rear section and each blade portion has a beveled outer cutting edge that angles downwardly from a first side to a second side;

wherein the blade portions and the body portion are integrally formed to provide an integral unitary broadhead; and wherein the blade portions are arranged relative to each other so that the second side of one of the blade portions is proximal to the first side of the adjacent blade portion.

2. A broadhead as claimed in claim 1 wherein the offset arrangement of the blade portions and the beveled edges cooperate to assist the rotation of the arrow.

3. A broadhead as claimed in claim 1 wherein the beveled edge of each blade portion is in the same orientation relative to the outward extension of the blade portions and a front position of the broadhead.

4. A broadhead as claimed in claim 1 wherein each of the blade portions tapers in a similar manner from the rear section to the front tip.

5. A broadhead as claimed in claim 1 wherein a surface of the second side of each of the blade portions extends continuously in the same plane to form part of an outer surface of the body portion.

6. A broadhead as claimed in claim 1 wherein each of the blade portions is asymmetrical about a perpendicular axis extending through a central longitudinal axis of the broadhead.

7. A broadhead as claimed in claim 1 wherein the beveled outer cutting edge of each of the blade portions has an angled edge section to form a broad tip at the front end.

8. A broadhead as claimed in claim 1 wherein the body portion comprises a threaded section for fixing to an arrow shaft.

9. An arrow comprising a broadhead as claimed in claim 1, comprising fletching attached adjacent an end of the arrow.

10. An arrow comprising a broadhead as claimed in claim 1 wherein the blade portions of the broadhead align with fletching at the opposite end of the arrow so as to promote rotation of the arrow during flight in a coordinated manner.

* * * * *